US006406115B2

(12) United States Patent
Mantell et al.

(10) Patent No.: US 6,406,115 B2
(45) **Date of Patent: *Jun. 18, 2002**

(54) METHOD OF PRINTING WITH MULTIPLE SIZED DROP EJECTORS ON A SINGLE PRINTHEAD

(75) Inventors: David Allen Mantell, Rochester; Gary A. Kneezel, Webster; James F. O'Neill, Penfield; Thomas A. Tellier, Wolcott, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/232,461

(22) Filed: Jan. 19, 1999

(51) Int. Cl.[7] ..... B41J 2/205
(52) U.S. Cl. ..... 347/15
(58) Field of Search ..... 347/15, 40, 12, 347/41

(56) References Cited

U.S. PATENT DOCUMENTS

| | | | | | |
|---|---|---|---|---|---|
| 4,571,599 | A | | 2/1986 | Rezanka | 347/87 |
| RE32,572 | E | | 1/1988 | Hawkins et al. | 216/27 |
| 4,739,415 | A | * | 4/1988 | Toyono et al. | 347/12 |
| 5,049,898 | A | * | 9/1991 | Arthur et al. | 347/19 |
| 5,192,959 | A | | 3/1993 | Drake et al. | 347/42 |
| 5,241,325 | A | * | 8/1993 | Nguyen | 347/49 |
| 5,268,767 | A | * | 12/1993 | Kurtin et al. | 347/40 |
| 5,300,968 | A | | 4/1994 | Hawkins | 347/12 |
| 5,412,410 | A | | 5/1995 | Rezanka | 347/15 |
| 5,726,690 | A | * | 3/1998 | Bohorquez et al. | 347/15 |
| 5,731,827 | A | * | 3/1998 | Mantell et al. | 347/40 |
| 5,745,131 | A | | 4/1998 | Kneezel et al. | 347/15 |
| 6,106,093 | A | * | 8/2000 | Nagoshi et al. | 347/15 |
| 6,113,223 | A | * | 9/2000 | Tanaka et al. | 347/65 |

FOREIGN PATENT DOCUMENTS

| | | | | |
|---|---|---|---|---|
| EP | 0516366 A2 | * | 2/1992 | B41J/2/205 |

* cited by examiner

*Primary Examiner*—John Barlow
*Assistant Examiner*—Julian D. Huffman
(74) *Attorney, Agent, or Firm*—Oliff & Berridge, PLC

(57) ABSTRACT

A printhead uses large and small drop ejectors to achieve efficient gray scale printing. The printhead is arranged with a close packed configuration of alternating large and small nozzles positioned to maximize coverage while minimizing the volume of ejected ink. The printhead may be operated in a single pass mode or dual pass mode. In the single pass mode, complete coverage is effected by rippling through the odd numbered jets first and then rippling through the even numbered jets. The position of the small spots from the even numbered jets can be adjusted to maximize coverage and counteract offset between nozzle centers. Printheads with different size nozzles can also be operated by a staggered firing method using dual passes to offset spots in the scan direction by shifting the printhead between passes or alternating between groups of large and small nozzles. Further improvements to image quality can be realized by shifting the spots in the direction perpendicular to the scanning direction by tilting the printhead or offsetting the nozzles with respect to the ink channels on the printhead.

17 Claims, 9 Drawing Sheets

METHOD OF PRINTING WITH MULTIPLE SIZED DROP EJECTORS ON A SINGLE PRINTHEAD

RELATED APPLICATION

This application is related to U.S. Ser. No. 09/233,110, filed simultaneously herewith.

BACKGROUND OF THE INVENTION

1. Field of Invention

The present invention relates generally to a liquid ink printing apparatus and a method for gray scale printing. More particularly, the invention relates to an ink jet printhead having different size drop ejectors.

2. Description of Related Art

Liquid ink printers of the type frequently referred to as continuous stream or as drop-on-demand, such as piezoelectric, acoustic, phase change wax-based or thermal, have at least one printhead from which droplets of ink are ejected towards a recording sheet. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

An ink jet printhead can include one or more thermal ink jet printhead dies having an individual heater die and an individual channel die. The channel die includes an array of fluidic channels which bring ink into contact with the resistive heaters which are correspondingly arranged on the heater die. In addition, the die may also have integrated addressing electronics and driver transistors. Fabrication yields of die assemblies at a resolution on the order of 300–600 channels per inch is such that the number of channels per die is preferably in the range of 50–500 under current technology capabilities. Since the array of channels in a single die assembly is not sufficient to cover the length of a page, the printhead is either scanned across the page with a paper advance between scans or multiple die assemblies are butted together to produce a page width printbar. Because thermal ink jet nozzles typically produce spots or dots of a single size, high quality printing requires the fluidic channels and corresponding heaters to be fabricated at a high resolution on the order of 400–600 channels per inch.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Printers typically print information received from an image output device such as a personal computer. Typically, this received information is in the form of a raster scan image such as a full page bitmap or in the form of an image written in a page description language. The raster scan image includes a series of scan lines consisting of bits representing pixel information in which each scan line contains information sufficient to print a single line of information across a page in a linear fashion. Printers can print bitmap information as received or can print an image written in the page description language once converted to a bitmap consisting of pixel information.

In a printer having a printhead with equally spaced nozzles, each of the same size nozzles producing ink spots of the same size, the pixels are placed on a square first grid having a size S, where S is generally the spacing between the marking transducers or channels on the printhead as illustrated in a sample printing pattern of FIG. 2. The nozzles 60 (schematically represented as triangles) traverse across a recording medium in the scan direction X as illustrated. The nozzles, which are spaced from one another a specified distance d, also known as the pitch, deposit ink spots or drops on pixel centers 62 on the grid having the grid spacing S in a direction perpendicular to the scanned direction, which is of course dependent on the spacing d. Typically, the nozzles and printing conditions are designed to produce spot diameters of approximately 1.414 (the square root of 2) times the grid spacing S. This allows complete filling of space, by letting diagonally adjacent pixels touch. A disadvantage of this printing scheme is that jaggedness may be objectionable at line edges, particularly for lines or curves at small angles to the scan direction as illustrated in FIG. 2. A first ellipse 64 located outside a second ellipse 66 in FIG. 2, indicate at what portions of the printed image the jaggedness would be most objectionable. In addition, print quality can be determined by 1) how much white space remains within the ring defined by the first and second ellipses, 2) how far the spots extend outside either the first or second ellipse, and 3) the amount of ink deposited on the recording medium.

One method of improving the line edge quality is to extend the addressability of the carriage to thereby allow dot placement at intermediate positions in the grid in the scanned direction. It is also possible to improve line edge quality by increasing the resolution. This, however, increases the complexity and cost of fabrication and typically slows down printing because of the additional number of spots to be printed.

The printheads and printing methods discussed above, and illustrated in FIG. 2 for example, provide for the printing of ink jet images having sufficient quality, especially when the resolution is increased upwards to 600 channels per inch. These printheads and methods, however, do not always provide images having the desired quality especially when considering gray scale levels, ink saving print modes, and printing throughput.

A majority of thermal ink jet printers produce spots or drops of ink all having the same diameter, within approximately about 10 percent, and are therefore not capable of gray scale printing. Drop volume or spot size is determined by many factors, including the heater transducer area, the cross sectional area of the ink ejecting channel or nozzle, the pulsing conditions necessary to create an ink droplet and the physical properties of the ink itself, such as the ink temperature. Although spot diameter changes of approximately ±10 percent are possible by changing pulsing conditions or ink temperature during printing, the given spot size is nominally constant to the extent that deliberate spot size variations cannot span a large enough range to be useful in gray scale printing.

Another method of improving printing quality, especially gray scale printing quality is to use groups of different size nozzles, as disclosed in U.S. Pat. No. 5,745,131 to Kneezel et al., which is hereby incorporated by reference into this disclosure. FIG. 3 illustrates printing according to U.S. Pat. No. 5,745,131 wherein a pattern is printed with a printhead having a first plurality of orifices 67 and a second plurality of orifices 68, producing spot diameters of 1.4S and 1.0S respectively. The spacing between nozzles of the first plurality of orifices 67 is again the distance d and the spacing between individual nozzles of the second plurality of orifices 68 is also the spacing d. The printing grid illustrated in FIG. 3 has a spacing of S between the pixel centers. The ink jet printer fires the individual nozzles of each plurality of orifices so that the ink drops land on the grid points in the scan direction. A somewhat better fill is achieved than previously illustrated in FIG. 2, at least in terms of the amount of ink used. Within the first ellipse 64 and the second ellipse 66, there are thirty-eight pixels of the large ink drops and sixteen pixels of the smaller ink drops which yields a more extensive coverage of ink within the first ellipse 64 and the second ellipse 66, even though the total amount of ink used is actually less than in FIG. 2. Since the number of nozzles within each of the first plurality of nozzles 67 and the second plurality of nozzles 68 are equivalent, the paper is advanced half the printhead length to achieve proper fill.

Various other methods and apparatus for gray scale printing with thermal ink jet printers and other ink jet printers include changing the ink drop size by either varying the driving signals to the transducer which generates the ink droplet or by creating a printhead which has a number of different sized ink ejecting orifices for creating gray scale images.

For example, U.S. Pat. No. 5,412,410 to Rezanka, discloses a printhead having different sized nozzles, which are alternated with each other according to size. As shown in FIG. 4, printhead 30 has large size nozzles 32 alternated with relatively small size nozzles 34 across the linear array. Each nozzle is spaced a distance S on center, with the large and small nozzles spaced apart by 2S, respectively. While gray scale printing can be effected by this arrangement, a large volume of ink is used and printing throughput or speed can be slow.

SUMMARY OF THE INVENTION

This invention addresses the above problems by providing methods of printing with a printhead having different size nozzles to effectively and efficiently fill spaces between pixels.

According to one aspect of the invention, a method of printing by ejecting droplets of ink onto a printing substrate with a printhead having a plurality of drop ejectors with different sizes, comprises the steps of firing a first size drop ejector in one printing pass, shifting the printhead with respect to the printing substrate, and firing a second size drop ejector in a second printing pass so that the ejected droplets form spots having different diameters that are aligned in the printing direction.

According to another aspect of the invention, a method of firing drop ejectors by ejecting droplets of ink onto a printing substrate with a printhead having a plurality of drop ejectors with different sizes, comprises the steps of tilting the printhead from vertical with respect to the scanning direction, firing a first size drop ejector in one printing pass, and firing a second size drop ejector in a second printing pass so that the ejected droplets form spots having different diameters that are offset in the direction perpendicular to the scanning direction.

According to a further aspect of the invention, a method of printing ink spots on a printing medium using at least two different size nozzles in a printhead array including a plurality of longitudinally extending channels, each channel having a central longitudinal axis and an end forming a nozzle for ejecting ink drops, wherein each nozzle is offset from the longitudinal axis of the associated channel and adjacent nozzles are spaced apart in opposing sides of the adjacent channels to achieve maximum spacing between adjacent nozzles on one side and minimum spacing between nozzles on another side, comprises the steps of firing one size nozzle in one printing pass, advancing the printing medium an odd number of pixels, and firing another size nozzle in another printing pass, wherein the different size nozzles are fired in a staggered fashion so that one size spot is displaced ½ pixel in both directions relative to the other size spot.

BRIEF DESCRIPTION OF THE DRAWINGS

Other objects, advantages and further features of this invention will be apparent from the following, especially when considered with the accompanying drawings, in which.

DETAILED DESCRIPTION OF PREFERRED EMBODIMENTS

Figure 1:
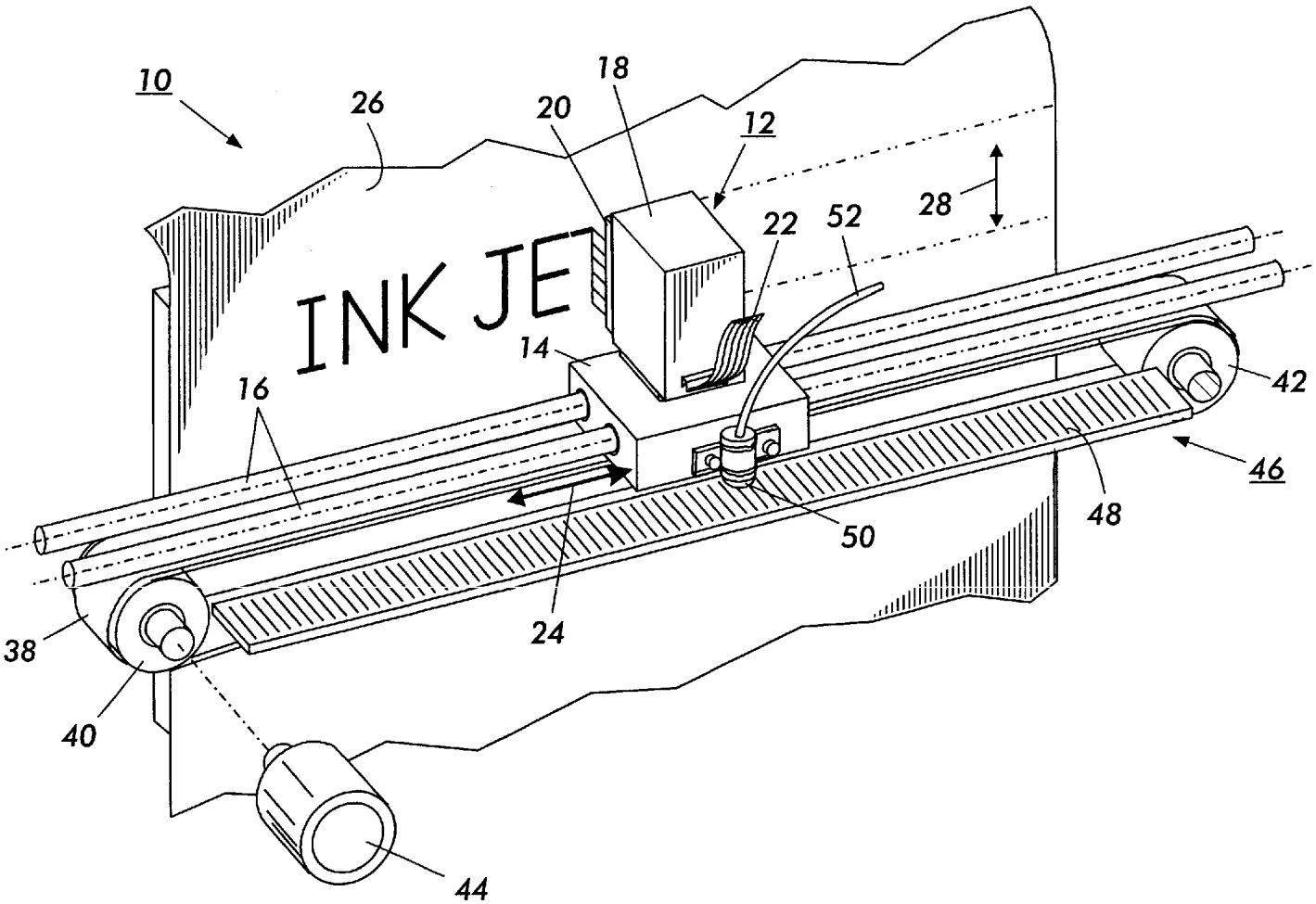
FIG. 1 is a partial schematic perspective view of an ink jet printer incorporating this invention.
Figure 2:
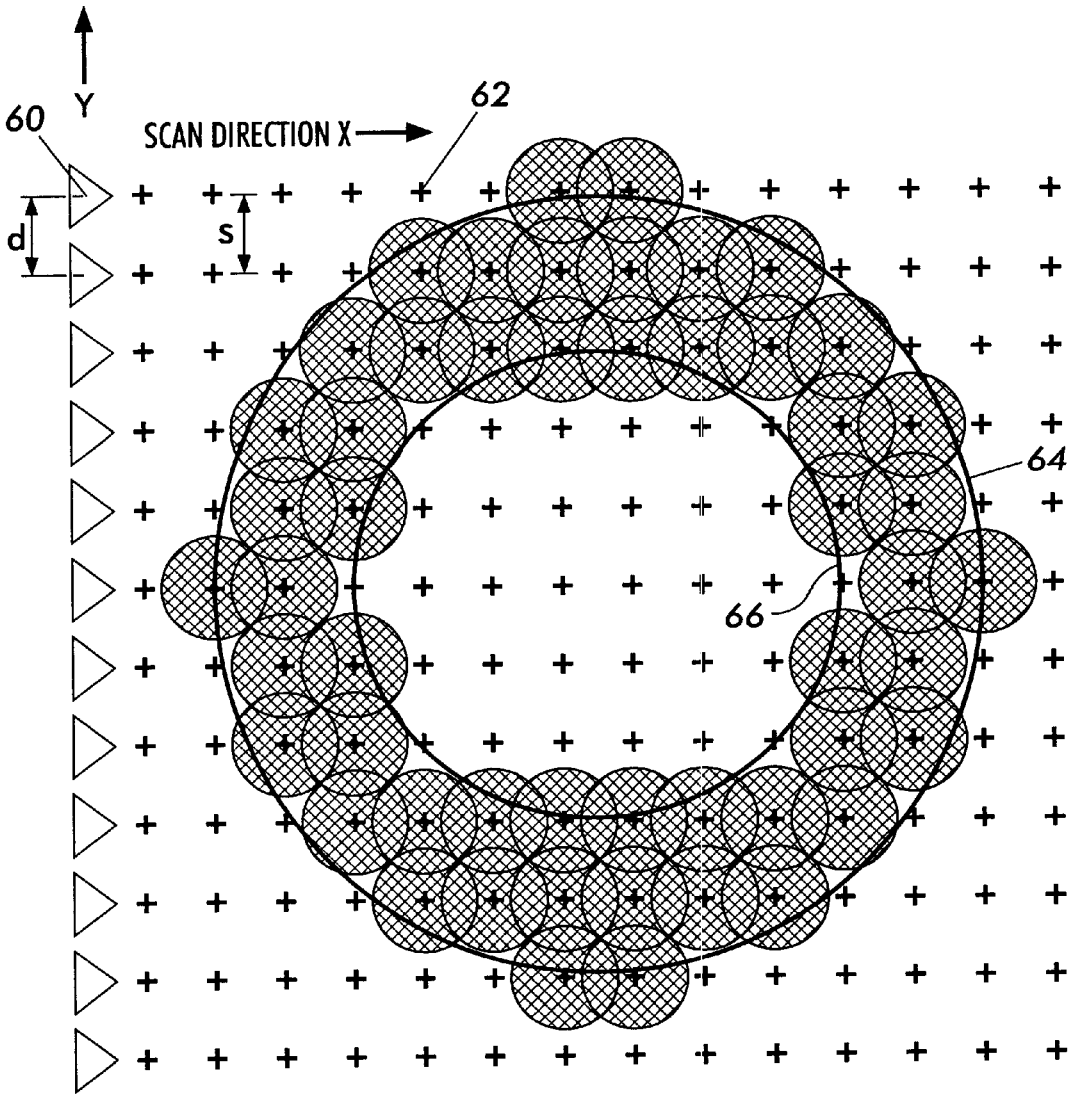
FIG. 2 PRIOR ART
FIG. 2 illustrates the locations of ink spots in a test pattern deposited by a printhead having ink ejecting nozzles of the same size.
Figure 3:
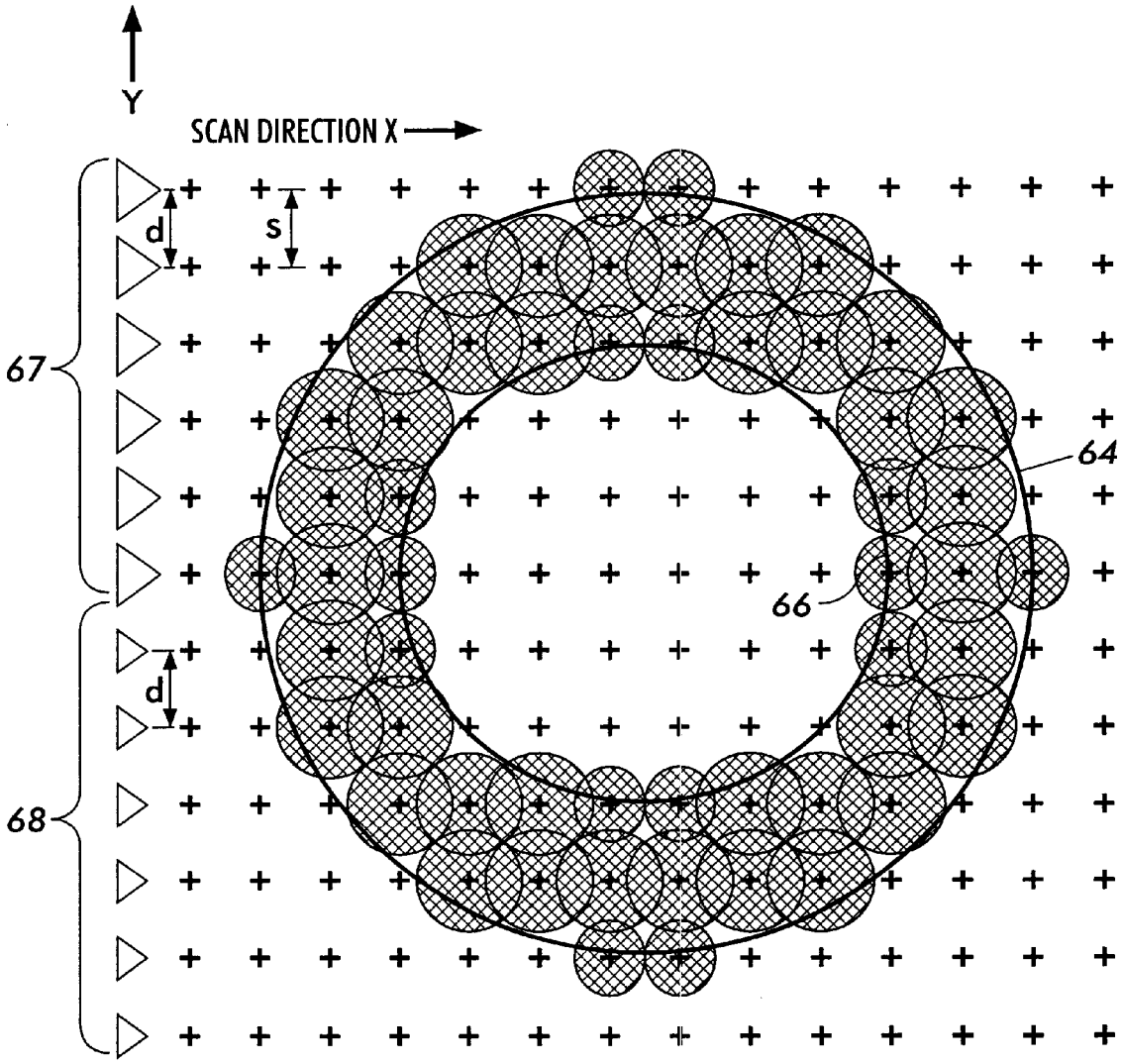
FIG. 3 PRIOR ART
FIG. 3 illustrates the locations of ink spots in a test pattern deposited by a printhead having ink ejecting nozzles of two different sizes.
Figure 4:
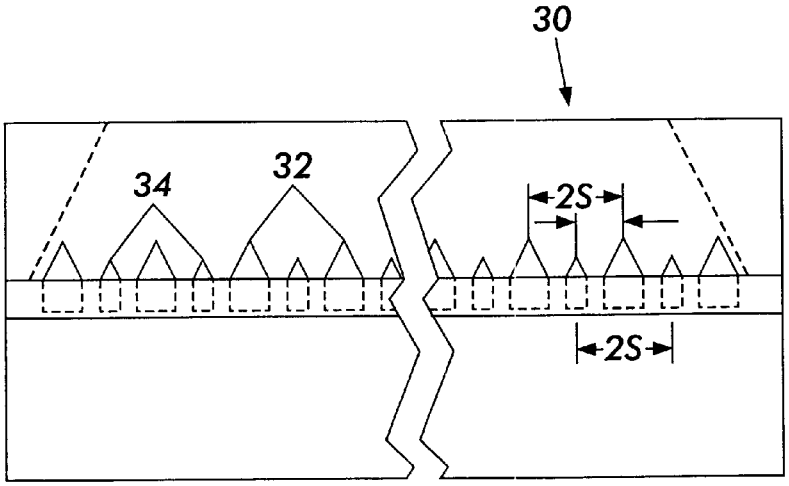
FIG. 4 PRIOR ART
FIG. 4 is a front view of a printhead having nozzles of different sizes disposed in an alternating pattern.

FIG. 1 illustrates a partial schematic perspective view of an ink jet printer 10 having an ink jet printhead cartridge 12 mounted on a carriage 14 supported by carriage rails 16. The printhead cartridge 12 includes a housing 18 containing ink for supply to a thermal ink jet printhead 20 which selectively expels droplets of ink under control of electrical signals received from a controller of the printer 10 through an electrical cable 22. The printhead 20 contains a plurality of ink channels, which carry ink from the housing 18 to respective ink ejectors, such as orifices or nozzles.

When printing, the carriage 14 reciprocates or scans back and forth along the carriage rails 16 in the directions of the arrow 24. As the printhead cartridge 12 reciprocates back and forth across a recording medium 26, such as a sheet of paper or transparency, droplets of ink are expelled from selected ones of the printhead nozzles towards the sheet of paper 26. The ink ejecting orifices or nozzles are typically arranged in a linear array perpendicular to the scanning direction 24. During each pass of the carriage 14, the recording medium 26 is held in a stationary position. At the end of each pass, however, the recording medium is stepped by a stepping mechanism under control of the printer controller in the direction of an arrow 28. For a more detailed explanation of the printhead and printing thereby, refer to U.S. Pat. No. 4,571,599 and U.S. Pat. No. Reissue 32,572, which are incorporated herein by reference.

The carriage 14 is moved back and forth in the scanning directions 24 by a belt 38 attached thereto. The belt 38 is driven by a first rotatable pulley 40 and a second rotatable pulley 42. The first rotatable pulley 40 is, in turn, driven by a reversible motor 44 under control of the controller of the ink jet printer in addition to the toothed belt/pulley system for causing the carriage to move. It is also possible to control the motion of the carriage by using a cable/capstan, lead screw or other mechanisms as known by those skilled in the art.

To control the movement and/or position of the carriage 14 along the carriage rails 16, the printer includes an encoder having an encoder strip 46 which includes a series of fiducial marks in a pattern 48. The pattern 48 is sensed by a sensor 50, such as a photodiode/light source attached to the printhead carriage 14. The sensor 50 includes a cable 52 that transmits electrical signals representing the sensed fiducial marks of the pattern 48 to the printer controller.

Figure 5:
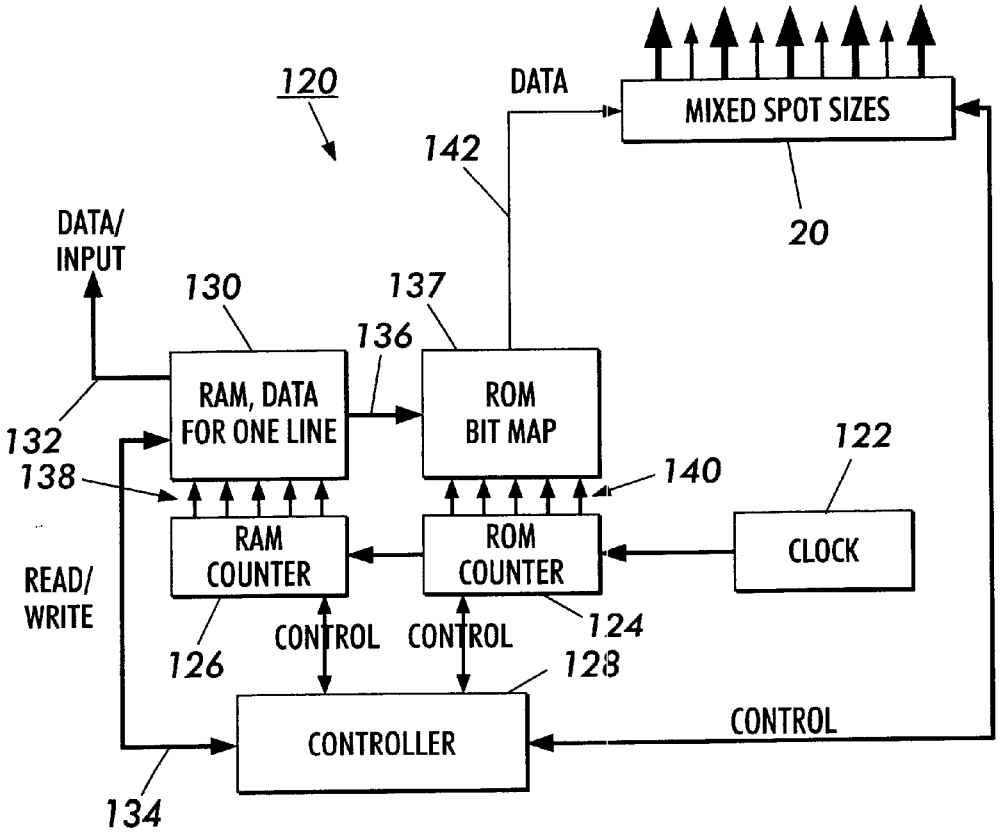
FIG. 5 is a schematic block diagram of a control system in accordance with this invention.

The printer controller can be a portion of any type of known control system typically used for selectively controlling nozzle function based on image data. An exemplary control system suitable for this invention is shown in FIG. 5. As seen, the printer controller or control system 120 includes a clock 122 having an output connected to a first counter 124. A second counter 126 is serially connected to the first counter 124. The clock 122 generates a sequence of clock pulses which advances the two counters serially connected together. A printer controller 128 controls the first counter 124 and the second counter 126 through separate control lines.

In addition, the control system 120 includes a RAM 130 having a data/input line 132 and a read/write input line 134 connected to the controller 128. The RAM 130 receives data or input information from a printer interface which is connected to an image generating system such as a personal computer. The RAM 130 stores image information which can include an entire document, a single line thereof, or a single loading of the printhead. An output line 136 of the RAM 130 is connected to a ROM 137 which contains the bitmapped patterns to be printed. An output line 136 of the RAM 30 is connected to a ROM 137 which contains the bitmapped patterns to be printed. The stored bitmapped patterns may be either alphanumeric characters for printing text, or might include a plurality of halftone cells each representing a different gray level.

In operation, the clock 122 generates a sequence of clock pulses which advances the first counter 124 which, in turn, advances the second counter 126. The second counter 126 generates a word over a plurality of output lines 138. The word present on the plurality of output lines 138 is applied to the RAM 130 to select a portion of the image to be printed. Typically, the word appearing on the output lines 138 is an address of the data stored in the RAM. The data stored in the RAM could include a number of from one to N, where N is equal to the number of different gray levels which can be printed.

The first counter 124 includes a plurality of output lines 140 connected to the ROM 137. The counter 124 selects the particular part of the pattern or halftone cell to be loaded into the printhead based on an output 136 of the RAM 130 which is an address for the ROM 137 containing the bitmapped pattern to be printed. Once the first counter 124 selects the particular portion of the bitmap pattern to be loaded, the ROM 137 outputs the necessary data over a first data line 142 connected to a printhead 20, which prints large and small spots.

Figure 6:
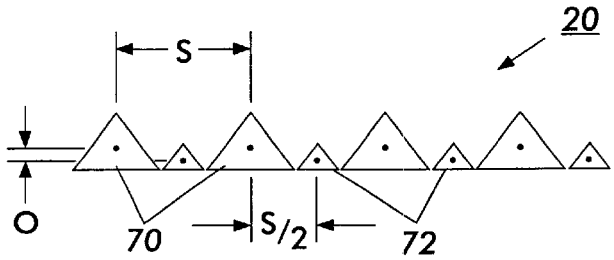
FIG. 6 is a schematic diagram of the alternating size nozzles in accordance with this invention.

The printhead 20 has different size drop ejectors or nozzles within a single printhead die, as shown in FIG. 6. The information output to printhead 20 is loaded by a shift register (not shown) resident in the printhead. An example of such a shift register and appropriate printhead electronics for use in the present invention is described in U.S. Pat. No. 5,300,968 to Hawkins, herein incorporated by reference. When the loading of the data to the printhead 20 is complete, the information is latched and the individual nozzles eject ink while the next row of data is being loaded into the printhead 20. It is possible to load several rows of data for each output of the RAM 130. In this way, the printer controller 128 is not burdened with the task of generating the specific bitmap for each density level.

FIG. 6 shows the preferred arrangement of alternating large and small drop ejectors, with large nozzles 70 disposed directly adjacent small nozzles 72 within a single array on printhead 20. In this arrangement, the primary or large nozzles 70 are spaced apart at their center points a distance S with the small nozzles 72 closely packed therebetween. Thus, the distance between the adjacent nozzle centers is S/2. The centers of adjacent nozzles are offset a distance O. This close packed arrangement, with small nozzles disposed in the space between large nozzles, allows for firing in a single pass. Such close packed configuration allows gray scale generation, while maintaining high productivity. The entire composite structure has, for example, 300 dpi (dots per inch) periodicity, but allows a high quality gray scale printing that is better than 300×600 and is faster than the true 600×600 resolution printing.

Preferably, for the example of S=1/300 inch, the large nozzles are at least 40 μm, and preferably 50 μm wide at their largest point, and the small nozzles are at least 20 μm, and preferably 25 μm at their largest point, with a channel land width between nozzles of about 5 or 6 μm to achieve adequate sealing. In triangular shaped nozzles as shown in FIG. 6, the width would be measured at the base of the opening. Large nozzles that are 50 μm wide provide complete space filling between spots deposited on the printing substrate with a single spot size at 300 spi (spots per inch), with low ink viscosity and appropriately sized heating resistors. At 300 spi, the spacing S between same size nozzles is about 84.5 μm, with large nozzles at 50 μm and small nozzles at 25 μm fit therebetween. By this, the heater centers and channel centers would be on 600 spi spacing, but in a single printing pass it is possible to use large spots and small spots where desired. This is not possible in prior art arrangements, in which a standard 600 spi printhead cannot use channels as large as at least 40–50 μm because the channels are on a 42.3 μm centers and require reliable sealing.

Figure 7A:
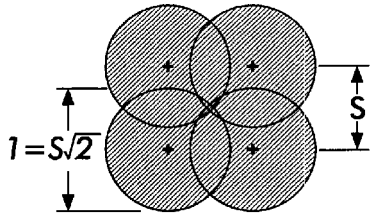
FIG. 7A shows a pattern of spots ejected from a printhead with the same size nozzles.
Figure 7B:
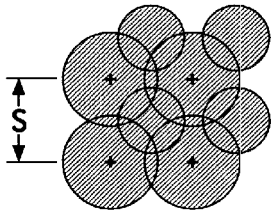
FIG. 7B shows a pattern of spots ejected from a printhead with different size nozzles in accordance with this invention.
Figure 7C:
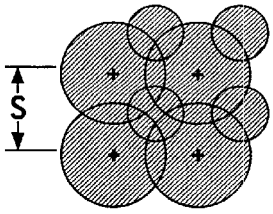
FIG. 7C shows another pattern of spots ejected from a printhead with different size nozzles in accordance with this invention.

Typically, in prior art devices that deposit a single spot size, to ensure overlap of diagonally adjacent spots, the spot size D is selected as S√2 (i.e., 1.414S) or slightly greater, as seen in FIG. 7A. However, according to the close pack arrangement of this invention, the spots do not have to be as large as S√2 to fill the space. Spot sizes of 1.1S, for the large spots, and 0.8S, for the small spots, as shown in FIG. 7B provide complete filling with additional coverage to allow for misdirected spots. In this case, the area of the small spots is about half the area of the large spots. Other combinations of large and small spots are also possible, such as 1.2S for the large spots and 0.6S for the small spots as shown in FIG. 7C. In this case, the area of the small spots is about one quarter of the area of the large spots. In each of these arrangements, the printed image is superior because the small spots protrude less beyond the edge of the margin of printing. The small spots that do protrude can even be totally or partially eliminated.

Figure 8:
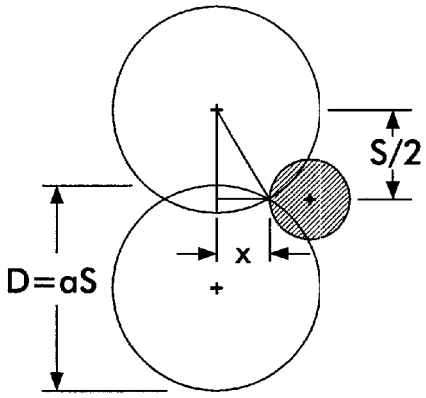
FIG. 8 is a schematic diagram showing the method of determining the optimum spacing and overlap between spots according to this invention.

As shown in FIG. 8, the optimal diameter D of the large spot to completely cover white spaces with minimum overlap can be determined. Using this determination, an efficient balance can be obtained between coverage and ink usage, i.e. the maximum area covered with minimum ink volume. This is an important parameter in ink deposition due to the ink usage limitations imposed by print cartridge capacity and by required ink drying time after printing. Ejection of less ink also allows faster refill of the channel and enables printing speeds in excess of the speed for 300×600 spi printing with a single spot size.

As an example of ink volume savings, referring to FIG. 7A, a grouping of four spots of standard uniform spot size of 1.414S has a total area coverage of $2\pi S^2$. In comparison, FIG. 7B shows a grouping of four spots of diameter 1.1S and four spots of diameter 0.8S. In this case, the total area coverage is $1.85\pi S^2$. In FIG. 7C, which shows a grouping of four spots of diameter 1.2S and four spots of diameter 0.6S, the total area coverage is $1.8\pi S^2$. This represents a significant ink savings when viewed in the context of a page or entire document of print.

The prior art example of FIG. 7A shows the smallest size spot that will completely cover the paper with no white spaces, if all jets are perfectly directed and all spots have the same size. The examples of FIG. 7B and FIG. 7C allow greater spot overlap than FIG. 7A and accordingly allow full coverage even if some spots are slightly smaller or slightly misdirected. Nevertheless, both examples shown in FIGS. 7B and 7C use less ink than the prior art FIG. 7A. An even more accurate comparison of ink savings can be obtained by comparing the two spot size arrangement to a single spot size arrangement by calculating the minimum total area of the two spots, which allows full coverage.

Assuming for purposes of illustration that the diameter of the large spots in FIG. 8 is D=aS (where $1.0<a<\sqrt{2}$), the point of intersection of the three adjacent spots occurs a distance $=0.5S(a^2-1)^{0.5}$ from the line joining the two centers. The minimum radius of the smaller spot is thus $r=0.5S(1-(a^2-1)^{0.5})$. For perfect overlap of the large and small spots, if the large spot size diameter is 1.2S, the small spot diameter (2r) must be at least 0.34S. The area of the four large spots plus the four small spots is $\text{Area}=2\pi S^2(a^2-(a^2-1)^{0.5})=1.553\pi S^2$. If the large spot diameter is 1.1S, then the small spot diameter must be at least 0.54S. The total area of this configuration is $1.503\pi S^2$. By differentiating the formula for Area with respect to "a" and setting the result to 0, it is found that the minimum total area is obtained when the large spot diameter is $1.25^{0.5}S=1.12S$, and the small spot diameter is 0.5S. The total area is then $1.5\pi S^2$. This represents an ink savings of 25% relative to the single spot size D=1.414S case in FIG. 7A. In practice, since the layer of deposited ink is thinner for smaller spots, the drop volume savings may be even more than 25%.

Although the above calculation shows the optical spot size combination for minimal ink usage assuming perfect spot placement and perfectly uniform spot size, in actual printing situations there is variation in both spot placement and spot size. To compensate, it is common practice for prior art printheads having a single spot size to make the spot size a little larger (on the order of 10% larger) than the minimum spot size. For the corresponding optimal spot size combination for minimum ink usage in a two-spot-size printhead for actual printing situations involving misdirection and spot size nonuniformity, the preferred range of spot diameters is greater than or equal to 1.12S−5% and less than or equal to 1.12S+15% for the large spots, and greater than or equal to 0.5S−5% and less than or equal to 0.5S+20% for the small spots. Even here it is understood that a given ink will produce different spot size on different papers and that spot size is a function of temperature in an ink jet printhead.

Figure 9A:
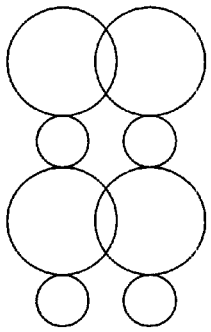
FIGS. 9A and 9B show a pattern of spots deposited in a first and second pass, respectively, according to a staggered method of firing according to this invention.
Figure 9B:
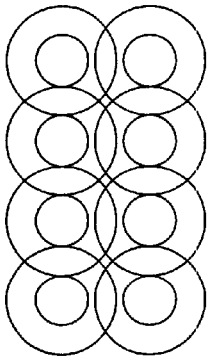

Printing with printheads having different size nozzles, especially to achieve gray scale printing, can be accomplished in two passes with the printhead shifted one pixel between passes so that both the large and small drops can cover the print grid. As seen in FIGS. 9A and 9B, in this method, the large and small drops line up on the same grid. The pixel shift can be accomplished by using two different paper advance distances, such as a one pixel advance on the left to right pass and an N−1 pixel advance on the right to left pass, where N is the total number of jets in the printhead.

Shift can also be accomplished by using a single paper advance distance if the total number of jets used is divisible by 2, but not divisible by 4. For example, if the printhead had 128 jets, with alternating large and small channels, only 126 jets would be used. The advance distance would then be 63 jet spacings. This allows large and/or small spots to be printed at every grid point. The printing throughput penalty would only be 2/128, which is less than 2%. The extra pixels could even be used to aid in stitching together the printhead passes.

Figure 10A:
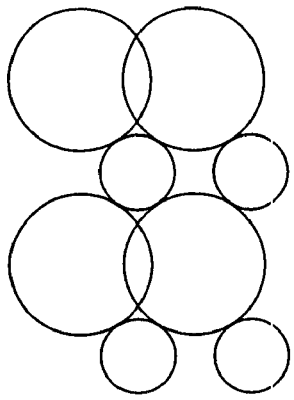
FIGS. 10A and 10B show another pattern of spots deposited in a first and second pass, respectively, according to a staggered method of firing according to this invention.
Figure 10B:
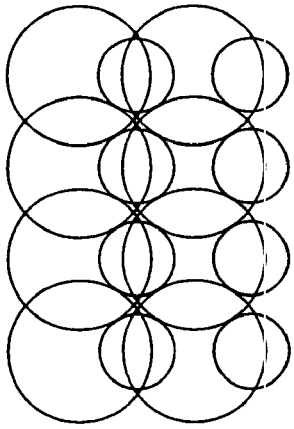

Additional range in gray scale is possible if the small drops are offset by ½ pixel from the large drops in the horizontal direction, as seen in FIGS. 10A and 10B. This can be accomplished by firing spots according to a staggered firing scheme. By this, the small drops can be offset by ½ pixel by firing all of the large drops first and then firing the small drops. The jet firing sequence for a 128 jet printhead printing four jets at a time would be 1, 3, 5, 7; 9, 11, 13, 15; . . . ; 121, 123, 125, 127; 2, 4, 6, 8; . . . ; 122, 124, 126, 128. All the large drops will print within half the print cycle time on the normal drop centers; the small drops will start printing after the printhead has moved ½ pixel across the paper. Thus, the drops will be automatically offset by ½ pixel in the horizontal direction, as shown in FIGS. 10A and 10B.

Another method of printing using staggered firing alternates between groups of large and small nozzles. In this method, banks of large (odd) and banks of small (even) pixels are printed alternately, but not the adjacent large and small drops. After the first bank of large drops are fired, the small drops half-way down the printhead are fired. The sequence continues, alternating large and small down the printhead. Each size wraps around to the top of the printhead again after printing the bottom bank. If the printhead is tilted by 1 pixel, the small drops are offset automatically by ½ pixel. In this case, nozzle openings are aligned along the bar but misaligned, by offset O, in the perpendicular scan direction because of the difference in heights of the nozzles. The difference in heights of the center of the nozzles causes the small drops to be misplaced slightly with respect to the large drops. The difference is in the scan direction, so a slight delay or advance in the firing of the small jets will compensate for the misalignment and the different size drops will be placed accurately. This staggered firing scheme allows the small pixels to be advanced relative to the large pixels to compensate for the offset.

For example, if the nozzle sizes are 25 and 50 microns, the difference in the heights of the centers is 12 microns (0.0005 inch). For 300 spi printers, if the jets are fired at 6 kHz, the required carriage speed is 20 inches per second. The printhead will cover the 12 mircon difference in centers in approximately 25 $\mu$sec. Thus, if the small nozzles are fired 25 $\mu$m before or after the large nozzles (depending on the orientation of the printhead and the scan direction), the pixel placement pattern in FIG. 11C representing the standard firing sequence is produced. By this, the large and small pixels can be placed on the same centers without having to fire adjacent pixels simultaneously.

To offset the large and small drops by ½ pixel using either one of the staggered firing sequences described above, the adjacent small and large jets should be fired 83 $\mu$sec (½ the print cycle time) plus or minus 25 $\mu$sec apart, depending on the orientation of the printhead and the scan direction. The above methods can be used with any type of printhead that has large and small nozzles, not necessarily those printheads that have alternating large and small nozzles.

Figure 11A:
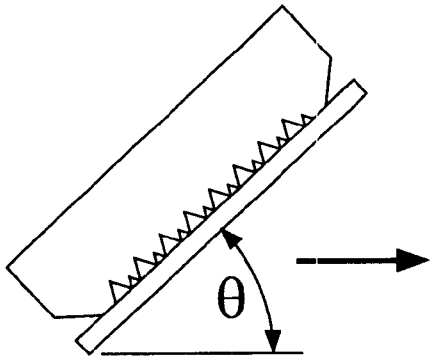
FIG. 11A shows a tilted printhead usable in a method of firing in accordance with this invention.

Image quality can be further improved if the small drops are offset in the perpendicular direction as well as the scan direction. This increases the ability to print with gray scale and minimize ink for full coverage. Perpendicular offset can be achieved by tilting the printhead, which is typically vertically oriented, with respect to the scan direction, as shown in FIG. 11A, with a 45° tilt. Greater tilt angles can be used to increase resolution. Small spots are automatically placed offset by ½ the spacing of the large drops in both direction. A slight staggering of the firing of the large and small nozzles is necessary to compensate for the offset in height of the nozzles in the scan direction.

Figure 11B:
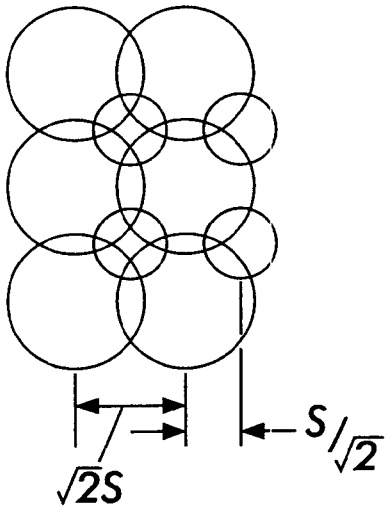
FIG. 11B shows the pattern of spots ejected in accordance with the printhead of FIG. 11A.

The large nozzle spacing is S on the printhead. When tilted 45°, the printed large spot spacing becomes $(S/2)\sqrt{2}$, seen in FIG. 11B. To obtain 300 spi spacing of the large spots on the paper, the large nozzles should be centered, for example, on 84.5×1.414=119.5 mircon spacing, with the small nozzles halfway in between (i.e. a channel to channel center spacing of about 60 mircons).

Figure 12A:
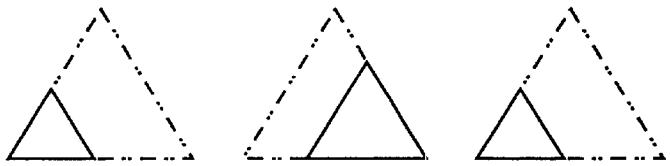
FIG. 12A is a schematic diagram of alternating sized nozzles having the nozzles offset from the associated channel centers in accordance with this invention.
Figure 12B:
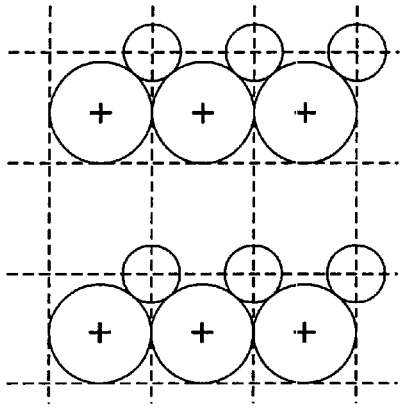
FIGS. 12B and 12C show patterns of spots deposited on a first and second pass, respectively, according to a method of firing of this invention.
Figure 12C:
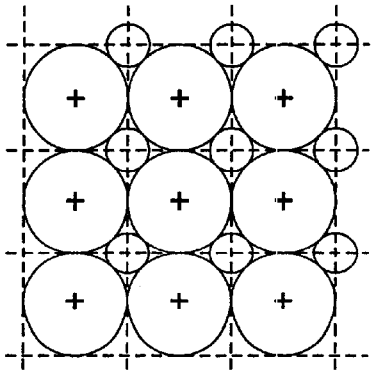

Another way to achieve perpendicular offset, without tilting, is to displace large and small drops by locating smaller nozzles off-center with respect to the channel, as shown in FIG. 12A. For example, for a 300 spi printhead, S=84.5 mircons, the channel diameter can be 70 mircons, and the two nozzle sizes can be 20 and 40 mircons. If the centers of the nozzles are both offset as far as possible toward each other, the spacing is 45 mircons. This is approximately ½S. By using two passes, advancing the paper an odd number of pixels, and staggering the printing of the large and small drops, the small drops can be displaced ½ pixel in both directions relative to the large drops, as seen in FIGS. 12B and 12C.

According to this invention, the printhead 20, having alternating large and small nozzles, can also be operated to print in a single pass. The offset in the printed pixel locations is set by the nozzle locations, in this case 0.5S. This offset is provided by rippling through all the odd numbered jets first (the large nozzles), and then rippling through all the even numbered jets (the small nozzles). For example, if 8 jets are fired at a time, the firing sequence in a printhead having 256 drop ejectors (128 large and 128 small) would be 1, 3, 5, 7, 9, 11, 13, 15; . . . ; 241, 243, 245, 247, 249, 251, 253, 255; 2, 4, 6, 8, 10, 12, 14, 16; . . . ; 242, 244, 246, 248, 250, 252, 254, 256. All the large drops will print within half the print cycle time on the normal drop centers. Small drops will start printing after the printhead has moved a half pixel across the paper. This allows complete space filling and gray scale on a single printhead pass.

Firing the entire set of large drops first then entire set of small drops; allows "tweaking" or adjustment of the small drop position. This is helpfil because the line of centers of the taller, large channels and the line of centers of the shorter, small channels differ slightly (by offset O). This offset can be overcome by delaying or advancing (depending on the scan direction) the firing of the grouping of small channels relative to the firing of the grouping of large channels.

This single pass method has the same throughput as printing 300×600 spi from a similar sized printhead having the same printing frequency. The difference is a result of the rippling through two different sets of 128 jets, while the 300×600 case will ripple through the same set of 128 jets twice in advancing by 1/300 inch in the scan direction. A 600×600 printhead having the same printing length (i.e. 256 jets) and same frequency has only half the printing throughput because after rippling through all 256 jets it is only able to advance by 1/600 inch in the scan direction.

Additionally, different pulsing conditions (pulse width and/or voltage) may be used for the larger and smaller drop ejectors to help determine the size of the ejected droplets. Since only large drops are fired with large drop ejectors (and small with small), different heater sizes with different resistors may be used for the two drop ejector designs. The combination of large and small spots provides smoother tone reproduction since halftone cell that uses various combinations of large and small spot sizes can produce a greater number of gray levels.

Another printing option is to address each offset grid point on the printing medium with either large or small spots by using multiple passes and a printhead advance that successively places rows of small spots in line with rows of large spots. This method would result in a slower throughput than the above described single pass method.

While this invention has been described in conjunction with specific embodiments thereof, it is evident that many alternatives, modifications, and variations will be apparent to those skilled in the art. For instance, the present invention is not limited to scanning type carriage printers but also includes partial width scanned printhead, page width type printheads, and full width array abutable printheads. The invention is applicable to monochrome printheads or printheads segmented to print a variety of colors. Also, while the embodiments discussed have used the example of side-shooter type printheads, the invention may be extended in obvious ways to the use of roofshooter type printheads in which the nozzles may be arranged in two-dimensional arrays. Accordingly, it is intended to embrace all such alternatives, modifications and variations that fall within the spirit and broad scope of the appended claims.

What is claimed is:

1. A method of printing by ejecting droplets of ink onto a printing substrate with a printhead having a plurality of drop ejectors with different sizes, comprising:

firing a first size drop ejector during a first printing pass;

shifting the printhead with respect to the printing substrate; and firing a second size drop ejector during a second printing pass so that the ejected droplets form spots having different diameters that are aligned in the printing direction, wherein shifting the printhead includes advancing the printing substrate a first amount for the first pass and advancing the printing substrate a second amount for the second pass, wherein the second amount is different than the first amount and shifting the printhead includes selectively firing a number of ejectors n, where n>0 and n is an even number not evenly divisible by four, to allow different size spots to be printed at every printing point.

2. The method of claim 1, wherein the step of shifting includes shifting the printhead an amount equal to an odd number of pixels.

3. The method of claim 1, wherein the step of firing a first size drop ejector includes firing all of the drop ejectors having the first size, and the step of firing the second size drop ejector includes firing all of the drop ejectors having the second size after the drop ejectors having the first size have been fired.

4. The method of claim 3, wherein the step of shifting the printhead includes shifting the printhead an amount equal to n+½ pixel, where n is an integer, so that the spots formed by the second size drop ejectors are horizontally offset from the spots formed by the first size drop ejectors.

5. The method of claim 3, wherein the first and second size drop ejectors are arranged in an alternating pattern and the step of firing the first size drop ejector includes firing every other drop ejector in half the printing cycle time.

6. The method of claim 3, the step of firing the first and second size drop ejectors are arranged in banks and the step of firing the first size drop ejector and the step of firing the second size drop ejector includes alternately firing different size drop ejectors down the length of the printhead that are not adjacent to each other.

7. The method of claim 6, wherein the step of shifting the printhead includes tilting the printhead by one pixel to create an offset of ½ pixel for the spots formed by the second size drop ejectors.

8. The method of claim 1, wherein the step of firing the second size drop ejector includes delaying or advancing the firing to compensate for misalignment between the different size spots.

9. The method of claim 1, wherein the steps of firing the first size drop ejector includes firing all of the drop ejectors having the first size in a first half of the print cycle time, and the step of firing the second size drop ejector includes firing all of the drop ejectors having the second size in a second half of the print cycle time.

10. The method of claim 1, further comprising the step of tilting the printhead with respect to the scanning direction to create a vertical offset between spots of different diameters.

11. The method of claim 10, wherein the step of tilting the printhead includes tilting the printhead about 45 degrees with respect to vertical.

12. A method of printing by firing drop ejectors to eject droplets of ink onto a printing substrate with a printhead having a plurality of drop ejectors with different sizes, comprising:

tilting the printhead from vertical with respect to the scanning direction;

firing a first size drop ejector in one printing pass; and firing a second size drop ejector in a second printing pass so that the ejected droplets form spots having different diameters that are offset in the direction perpendicular to the scanning direction, wherein the printhead is tilted to create an offset of one-half pixel formed by the second size drop ejector, wherein shifting the printhead includes selectively firing a number of ejectors n, where n>0 and where n is an even number and n is not evenly divisible by four, to allow different size spots to be printed at every printing point.

13. The method of claim 12, wherein the step of tilting the printhead includes tilting the printhead by about 45 degrees from vertical.

14. The method of claim 12, further comprising the step of staggering firing of the drop ejectors to compensate for the offset in height of the different size drop ejectors in the scanning direction.

15. A method of printing ink spots on a printing medium using at least two different size nozzles in a printhead array including a plurality of longitudinally extending channels, each channel having a central longitudinal axis and an end forming a nozzle for ejecting ink drops, wherein each nozzle is offset from the longitudinal axis of the associated channel and adjacent nozzles are spaced apart in opposing sides of the adjacent channels to achieve maximum spacing between adjacent nozzles on one side and minimum spacing between nozzles on another side, the method comprising:

firing one size nozzle in one printing pass;

advancing the printing medium an odd number of pixels; and firing another size nozzle in another printing pass, wherein the different size nozzles are fired in a staggered fashion so that one size spot is displaced ½ pixel in both directions relative to the other size spot, wherein advancing the printhead includes selectively firing a number of ejectors n, where n>0 and n is an even number not evenly divisible by four, to allow different size spots to be printed at every printing point.

16. The method of claim 15, wherein the different size nozzles are arranged in an alternating pattern.

17. The method of claim 15, wherein the second fired nozzles have a smaller size than the first fired nozzles to produce smaller spots that are offset ½ pixel.

* * * * *